US007699455B2

(12) United States Patent
Matsuda et al.

(10) Patent No.: US 7,699,455 B2
(45) **Date of Patent: *Apr. 20, 2010**

(54) INKJET RECORDING APPARATUS

(75) Inventors: Tadayuki Matsuda, Hitachi (JP); Yoshiharu Takizawa, Hitachi (JP); Mamoru Okano, Hitachi (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/249,384

(22) Filed: Oct. 10, 2008

(65) Prior Publication Data

US 2009/0040248 A1 Feb. 12, 2009

Related U.S. Application Data

(63) Continuation of application No. 11/367,544, filed on Mar. 6, 2006, now Pat. No. 7,475,974.

(30) Foreign Application Priority Data

Mar. 11, 2005 (JP) ..... 2005-069263
Mar. 16, 2005 (JP) ..... 2005-074232

(51) Int. Cl.
*B41J 2/185* (2006.01)

(52) U.S. Cl. ..... 347/90

(58) Field of Classification Search ..... 347/73, 347/74, 84, 85, 89, 90

See application file for complete search history.

(56) References Cited

U.S. PATENT DOCUMENTS 3,929,071 A 12/1975 Cialone et al.
4,527,170 A 7/1985 Iwasaki et al.
4,849,774 A 7/1989 Endo et al.
6,527,379 B1 * 3/2003 Martin ..... 347/73

FOREIGN PATENT DOCUMENTS

JP 2000-203050 7/2000
JP 2001-138544 5/2001

OTHER PUBLICATIONS

Extended European Search Report issued in European Patent Application No. EP 06004487.2-2304/1700700, dated Jun. 4, 2009.
Japanese Notice of Rejection, w/ partial English translation thereof, issued in Japanese Patent Application No. JP 2005-069263 dated Feb. 2, 2010.

* cited by examiner

*Primary Examiner*—K. Feggins
(74) *Attorney, Agent, or Firm*—McDermott Will & Emery LLP

(57) ABSTRACT

An inkjet recording apparatus comprises a main body, a print head, and a cable. The main body includes an ink container for storing ink, an ink supply pump for supplying the ink, and an operation control section. The print head includes a nozzle for expelling the ink supplied from the main body as ink particles, charging electrodes for charging the ink particles, deflecting electrodes for deflecting the charged ink particles, and a gutter for collecting ink particles that have not been used for printing. The cable includes an ink supply path through which the ink is supplied from the main body to the print head, an ink collecting path through which the ink particles collected in the gutter are returned to the ink container, signal lines interconnecting the operation control section and the print head. An ink collecting pump for transferring the ink particles collected in the gutter to the ink container is disposed in the print head.

4 Claims, 10 Drawing Sheets

INKJET RECORDING APPARATUS

CLAIM OF PRIORITY

The present application is a Continuation of U.S. application Ser. No. 11/367,544, filed Mar. 6, 2006 now U.S. Pat. No. 7,475,974, and claims priority from Japanese applications serial No. 2005-69263, filed on Mar. 11, 2005 and serial No. 2005-74232, filed on Mar. 16, 2005, the entire contents of each of which are hereby incorporated by reference into this application.

BACKGROUND OF THE INVENTION

The present invention relates to an inkjet recording apparatus that expels ink continuously from a nozzle and prints characters or patterns on articles that are transferred on a production line.

Inkjet recording apparatus based on the continuous method, in which ink is expelled from a nozzle continuously, ink droplets being moving in the air are charged, and an electric field is used to deflect the ink droplets for printing, are widely used to print numerals and symbols on metal cans and plastic surfaces. Conventional inkjet recording apparatus comprise a main body, a recording head, and a cable for interconnecting the main body and the recording head, as disclosed in Japanese Application Patent Laid-Open Publication Nos. 2000-203050 and 2001-138544. The main body has an ink container for storing ink, a pump for supplying the ink from the ink container to the recording head, another pump for collecting ink from the recording head into the ink container, and a control section for controlling the operation of the recording apparatus. The recording head has a nozzle for expelling the ink supplied from the main body as ink particles, charging electrodes for charging the ink particles, deflecting electrodes for deflecting the charged ink particles by means of an electric field, and a gutter for collecting ink that has not been used. The cable for interconnecting the main body and the recording head includes a tube through which ink flows and electric wires that transmit electric signals to the recording head.

To collect unused ink particles from the gutter, the atmospheric pressure around the gutter needs to be negative, but the atmospheric pressure can be reduced only down to zero. In the structures of the conventional inkjet recording apparatus, the gutter is open to the atmosphere, so the maximum possible differential pressure produced by the ink collecting pump between the gutter and the ink collecting pump is equal to the atmospheric pressure. Accordingly, the maximum length of the ink collecting flow path between the main body of the inkjet recording apparatus and the recording head has to be limited to a length for which the differential pressure equal to the atmospheric pressure is enough to collect ink from the gutter to the main body equipped with the ink container. This has been an obstacle to flexible adaptation to user equipment.

Another problem with the conventional inkjet recording apparatus described above is that the pump for collecting ink not used in the recording head into the ink container is disposed in the main body. The inkjet recording apparatus related to the present invention is intended for use with a production line, so the length of the tube for interconnecting the main body and the recording head is generally preset in the range from about 2 m to 4 m. Therefore, the pump for collecting ink not used in the recording head into the main body must have a capacity enough to collect ink from a position 2 to 4 m apart. In this case, ink and air are collected together. When a pump is used to transfer a mixture of a liquid and a gas, if the pump is positioned near the transfer source, stable transfer with less flow rate variations in time can be achieved, as compared when the pump is positioned near the transfer destination. In the description that follows, the flow rate indicates the flow rate of a mixture of a liquid and a gas.

The conventional inkjet recording apparatus collects ink from a distant position, which needs a high flow rate so that ink can be collected stably even when the flow rate varies to a low value. As the temperature of the ink falls, its viscosity increases, thereby increasing the flow path resistance generated when the ink flows through the tube. If the recording head is positioned below the main body, the flow path resistance during collection becomes large. To collect ink stably even in a situation in which the flow path resistance during collection becomes large as described above, it is necessary to use a pump that has a high collection flow rate. The ink used by the inkjet recording apparatus related to the present invention needs to be dried quickly after printing, so methyl ethyl ketone (MEK) or another highly volatile substance is used as the solvent. When the collection flow rate is set to a large value, much air is sucked and the amount of ink solvent vapor increases, adversely affecting the environment. When persons work in a room in which a production line is installed, they also suffer from the adverse effect by the ink solvent vapor.

SUMMARY OF THE INVENTION

The present invention has an object to provide an inkjet recording apparatus that efficiently collects ink from the gutter while the inkjet recording apparatus is operating, allows a margin for the length of the ink collecting path, and reduces the amount of ink solvent vapor, which results in less effect on the environment and human bodies.

The present invention is concerned with an inkjet recording apparatus that comprises a main body, a print head, and a cable; the main body comprises an ink container for storing ink, an ink supply pump for supplying the ink, and an operation control section; the print head comprises a nozzle for expelling the ink supplied from the main body as ink particles, charging electrodes for charging the ink particles, deflecting electrodes for deflecting the charged ink particles, and a gutter for collecting ink particles that have not been used for printing; the cable includes an ink supply path through which the ink is supplied from the main body to the print head, an ink collecting path through which the ink particles collected in the gutter are returned to the ink container, and signal lines interconnecting the operation control section and the print head; an ink collecting pump for transferring the ink particles collected in the gutter to the ink container is disposed in the print head.

An amount of ink particles to be collected by the collecting pump is changed according to the measurement results of the charge state of the ink particles. The collection flow rate of the collecting pump is set in such a way that even when the fluid resistance is changed responsive to changes in ink temperature, the optimum collection flow rate is obtained. Since the difference in height between the ink collecting path and print head is input from a touch panel or the like, the collecting pump is set to an optimum collection flow rate.

DETAILED DESCRIPTION OF THE EMBODIMENTS

An embodiment of the present invention will be described with reference to the drawings.

Figure 8:
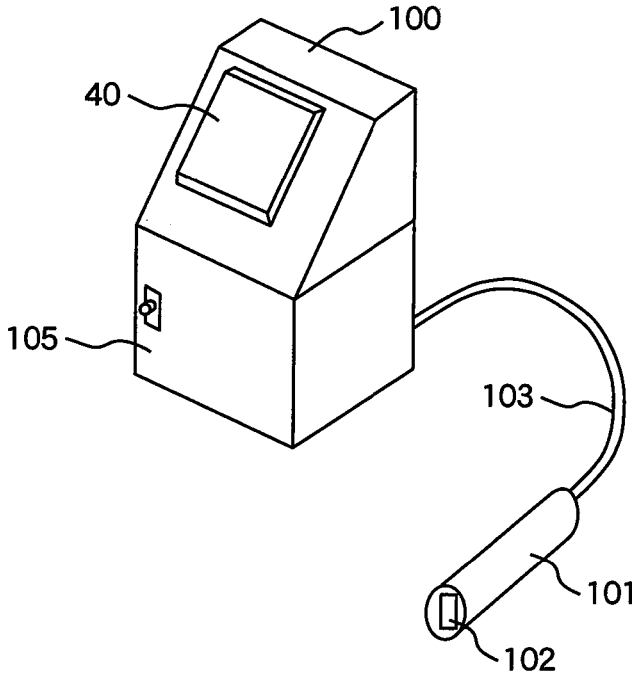
FIG. 8 shows an external diagrammatical view of the inkjet recording apparatus.

FIG. 8 shows an external diagrammatical view of the inkjet recording apparatus. Provided in the main body 100 are a control section of the inkjet recording apparatus and an ink circulating system comprising an ink container, pumps, and other components. The door 105 is opened and closed for maintenance work. A cable 103 extends from the main body 100; it includes a tube for transferring ink from the main body 100 to the print head (referred to below as the recording head in some cases) 101, another tube for collecting ink from the print head 101 into the main body 100, and wires for sending electric signals to the print head 101. The cable 103 is required to be elongated to allow for a situation in which there is a distance between the position where the main body 100 is installed and the position where the print head 101 is installed due to the circumstance of user equipment. A length of at least about 4 m is required.

The main body 100 further includes a liquid crystal panel (operation panel) 40, which is a touch panel, for accepting contents to be printed, print specifications, and other information from an operator. The operation panel 40 displays data for control by the recording apparatus, the operation status, and the like. The print head 101 is covered by a stainless cover, in which a printing section for producing ink particles and controlling the ink particles being moving in the air is accommodated. The ink particles produced in the inside of the print head 101 are expelled through an opening 102 formed at the bottom, adhere to a recording medium (not shown), and form an image.

Figure 9:
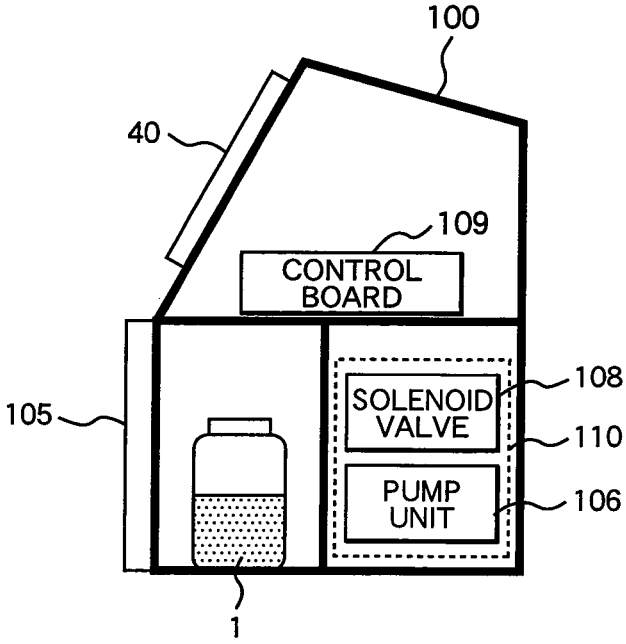
FIG. 9 shows the internal structure of the inkjet recording apparatus.

Next, the internal structure of the main body 100 will be described with reference to FIG. 9.

A control board 109 and other electric components are disposed on the top of the main body 100. A solenoid valve 108, pump unit 106, and other control parts in the circulating system are disposed at the main body bottom 110. An ink container 1 for storing ink to be supplied to the nozzle is accommodated near these parts. A door 105 is openable and closable, so the ink container can be drawn toward the door 105, simplifying replenishment and disposal of ink and other maintenance work.

Figure 10:
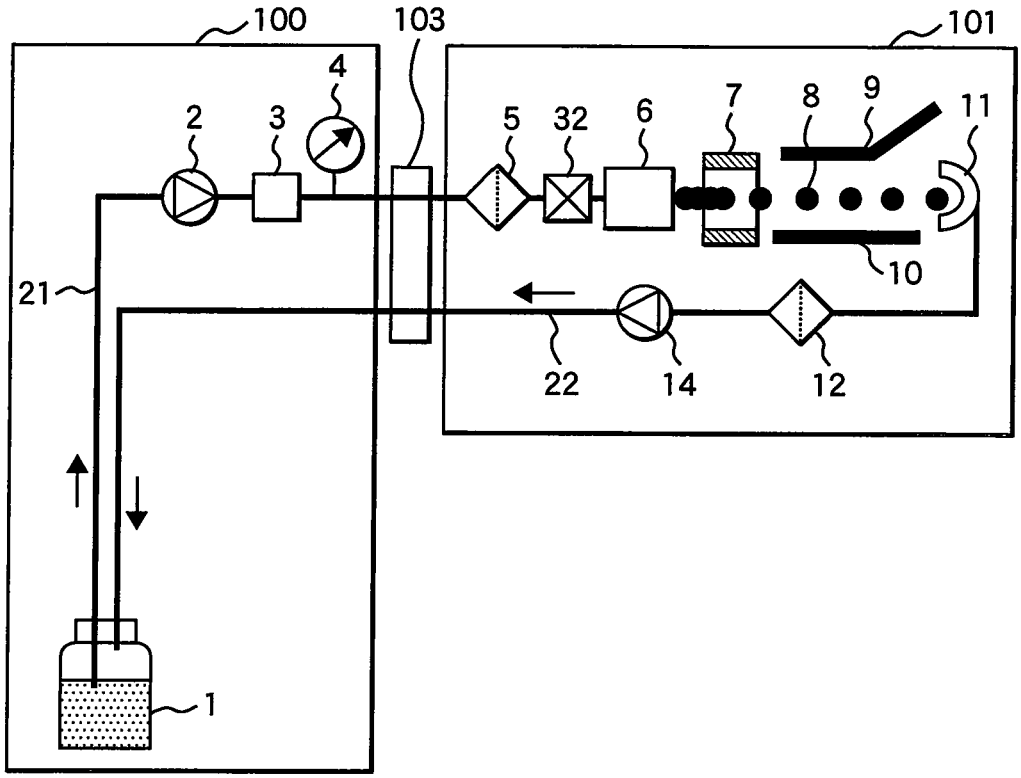
FIG. 10 illustrates ink circulation in the inkjet recording apparatus.

Next, the general structures of the ink circulating system and printing section of the inkjet recording apparatus according to the present invention will be described with reference to FIG. 10.

On the ink supply path 21 in the main body 100, there are provided an ink container 1 for storing ink, a supply pump 2 for supplying ink by pressure, a regulator 3 for adjusting the pressure of the ink, and a pressure gage 4 indicating the pressure of the supplied ink; on the ink supply path 21 in the recording head 101, a filter 5 for catching foreign materials in the ink and a solenoid valve 32 are provided in front of a nozzle 6. The nozzle 6 is provided with a piezoelectric device; when a sine wave at about 70 kHz is applied to the piezoelectric device, the ink expelled from an orifice disposed at the end of the nozzle 6 is broken down into particles while it is moving in the air. Charging electrodes 7 are connected to a recording signal source (not shown); when a recording signal voltage is applied to the charging electrodes 7, ink particles 8 expelled regularly from the nozzle 6 are charged. The upper deflecting electrode 9 is connected to a high-voltage source (not shown) and the lower deflecting electrode 10 is connected to ground, so an electrostatic field is formed between the upper deflecting electrode 9 and lower deflecting electrode 10. The ink particles 8 charged are deflected according to the amount of charge the ink particles 8 themselves have while they pass through the electrostatic field. The ink particles 8 then adhere to a recording medium (not shown) and form an image.

On the ink collecting path 22 in the recording head, a gutter 11, filter 12, and ink collecting pump (referred to below as the collection pump in some cases) 14 are provided; the gutter 11 collects the ink particles 8 that have not been charged by the charging electrodes 7 and thereby have not been deflected while passing through the electrostatic field; the ink particles 8 collected are returned to the ink container 1 so that they can be reused. In the structure in FIG. 10, the filter 12 is disposed on the inlet side of the collecting pump 14, but it may be disposed on the outlet side of the collecting pump, that is, on the ink container side on which a pressure is applied.

With the conventional inkjet recording apparatus, the collection pump 14 is disposed within the main body 100, so it sucks ink at a position 2 m to 4 m away from the recording head. The purpose of this structure is to make the apparatus compact by placing the ink supply pump and ink collecting pump at a single position. In this embodiment, however, a structure in which the collection pump 14 is disposed in the recording head is used. When the ink collecting pump is disposed near the recording head as in this embodiment, the distance from the gutter 11 to the collecting pump 14 can be significantly reduced as compared with the conventional distance. Accordingly, the collecting pump 14 can strongly suck ink collected in the gutter 11 with a large negative pressure (relative to the atmospheric pressure); most of the ink can be transferred by the pressure applied by the collecting pump 14 through the ink collecting path 22 to the ink container. If ink transfer by a pressure as in this embodiment becomes dominant, the restriction due to a differential pressure is eliminated and the cable 103 (ink collecting path 22) can be elongated sufficiently.

A pump having a smaller capacity than the conventional pumps can be used to smoothly collect ink, as described below, further making the apparatus compact. When the pump is used to transfer a mixture of a liquid and a gas, if the pump is positioned near the transfer source, stable transfer with less flow rate variations in time can be achieved, as compared when the pump is positioned near the transfer destination.

Figure 11:
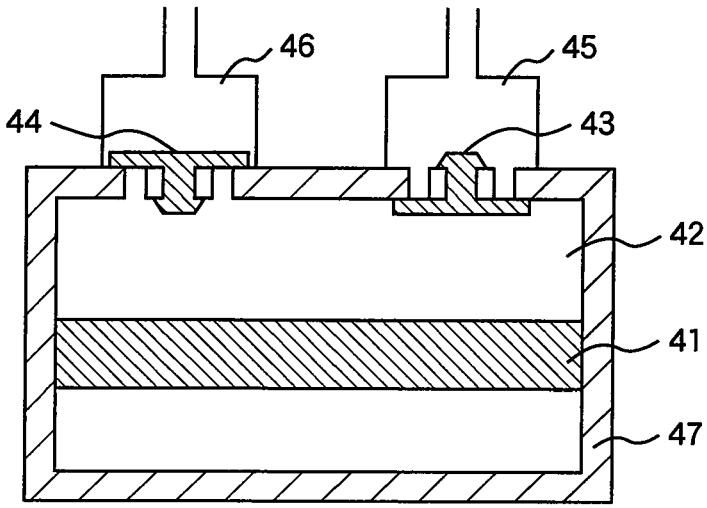
FIG. 11 is a schematic view of the ink collecting pump.

An example of the collecting pump 14 used in the present invention will be described below with reference to the drawings. FIG. 11 shows an example of the collecting pump 14 used in the present invention. The structure of the pump is not limited to the one in this embodiment, however.

The collecting pump 14 is a pump of diaphragm type.

The collecting pump has a main body case 47, a diaphragm 41 that reciprocates in the main body case 47, an ink chamber 42 that is formed between one side of the diaphragm 41 and the body case 47, an ink inlet port 45 and an ink outlet port 46 provided so as to communicate with the ink chamber 42, an inlet non-return valve 43 provided in the ink inlet port 45, and an outlet non-return valve 44 provided in the ink outlet port 46.

The ink inlet port 45 is connected to the gutter 11 in such a way that they communicate with each other; the ink outlet port 46 is connected to the ink collecting path 22 in such a way that they communicate with each other.

The inlet non-return valve 43 and outlet non-return valve 44 are in tight contact with the main body case 47 when the pump is not operating so that the difference between the atmospheric pressure and the pressure in the ink chamber 42 is eliminated.

Figure 12:
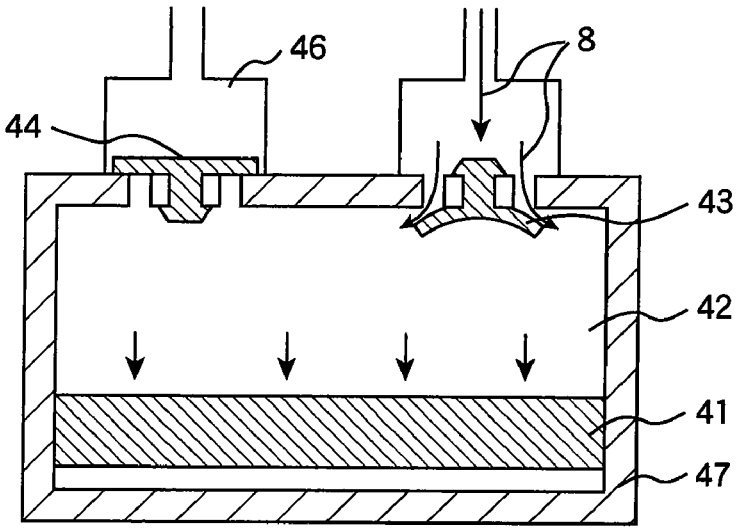
FIG. 12 illustrates ink suction operation of the ink collecting pump.

FIG. 12 shows how the collecting pump 14 sucks the ink particles 8 from the gutter 11.

When the diaphragm 41 moves in the direction of the non-return valves so that the volume of the ink chamber 42 is increased, a negative pressure is produced in the ink chamber 42, attracting the inlet non-return valve 43. When the inlet non-return valve 43 is attracted, the negative pressure in the ink chamber 42 passes through the ink inlet port 45 and reaches the gutter 11 ahead thereof, sucking the ink particles 8.

Conversely, the outlet non-return valve 44 is attracted by the negative pressure in the ink chamber 42 and is brought in tight contact with the main body case 47, preventing the negative pressure in the ink chamber 42 from being transferred to the ink outlet port 46.

Figure 13:
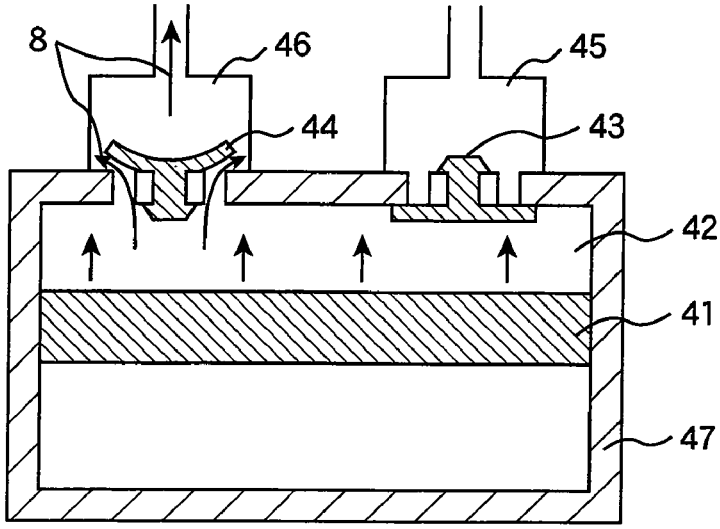
FIG. 13 illustrates ink discharge of the ink collecting pump.

FIG. 13 shows how the ink collecting pump 14 transfers the ink particles 8 by pressure to the ink container 1.

When the diaphragm 41 moves toward the non-return valves so that the volume of the ink chamber 42 is decreased, a positive pressure is produced in the ink chamber 42, pushing up the outlet non-return valve 44. When the reduction of the volume in the ink chamber 42 pushes up the outlet non-return valve 44, the ink particles 8 sucked into the ink chamber 42 are ejected into the ink container 1 through the ink outlet port 46.

Conversely, the inlet non-return valve 43 is pressed by the positive pressure in the ink chamber 42 and brought into tight contact with the main body case 47, preventing the positive pressure in the ink chamber 42 from being transferred to the ink inlet port 45.

Due to the reciprocal motion of the diaphragm 41 as described above, the ink particles 8 collected in the gutter 11 are sucked and transferred to the ink container 1.

The collecting pump 14 of diaphragm type has a simple structure, which comprises a reciprocating diaphragm, inlet non-return valve, and outlet non-return valve, so its performance does not change depending on the orientation in which the pump is installed, being advantageous in that the pump can be installed in a given orientation.

FIGS. 4A and 4B and FIGS. 5A and 5B show how the pressure in the tube is measured when a mixture of a liquid and gas is transferred through the tube, as well as measurement results. The transfer capacity of the pump is preset to about one-third the capacity of the ink collecting pump in the conventional inkjet recording apparatus.

Figure 4A:
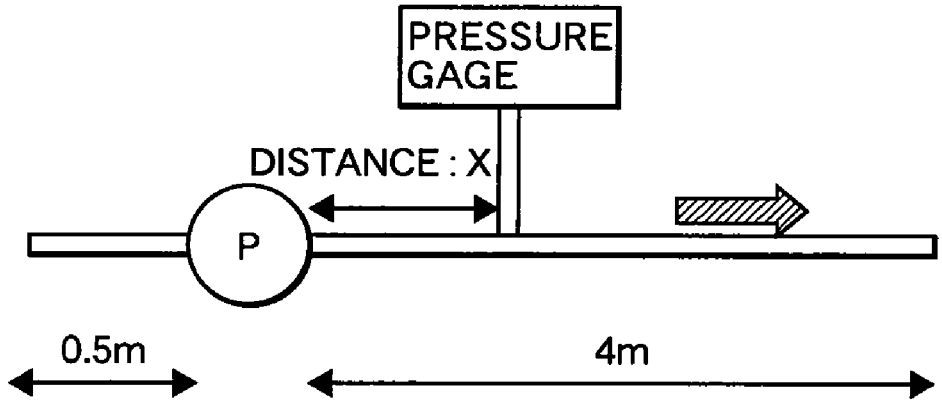
FIG. 4A shows a first state of the piping connected to the pump.
Figure 4B:
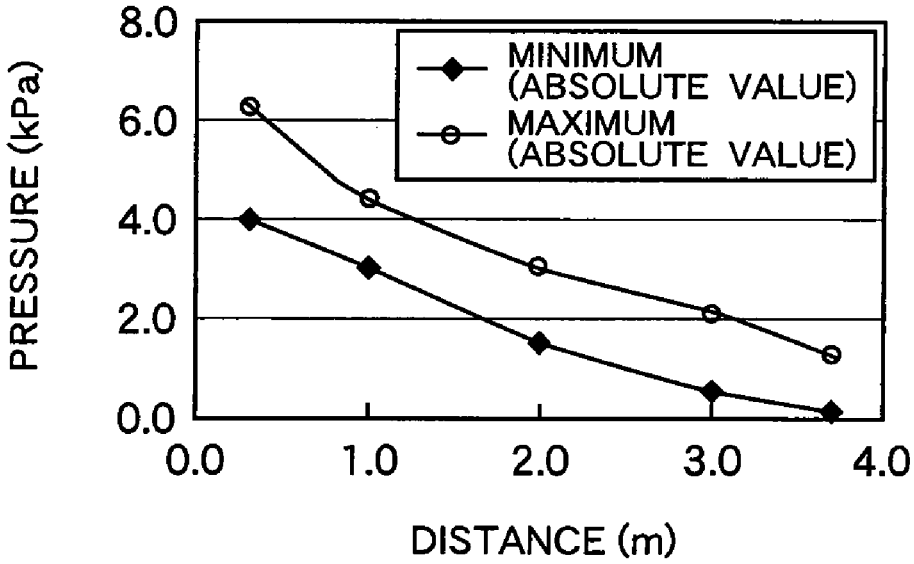
FIG. 4B shows the relationship between the distance of the piping and the pressure in the piping.

FIG. 4A shows a layout of the ink collecting pump and pressure gage, on the condition that the distance between the intake aperture and the ink collecting pump is 0.5 m, and the distance between the ink collecting pump and the discharge aperture is 4 m. FIG. 4B shows maximum pressures and minimum pressures measured at various measurement points on the ink collecting path on the discharge side, relative to the position (0) of the ink collecting pump. Measurement results on the intake side are not shown because the length eligible for measurement is 0.5 m at most. Maximum and minimum pressures are produced because the ink collecting pump used is a diaphragm pump, which expels the mixture of the liquid and gas at a frequency of about 30 Hz, generating pressure pulses during transfer. The pressure is gradually reduced as the distance relative to the ink collecting pump becomes large, indicating that stable transfer is carried out on the discharge side.

Figure 5A:
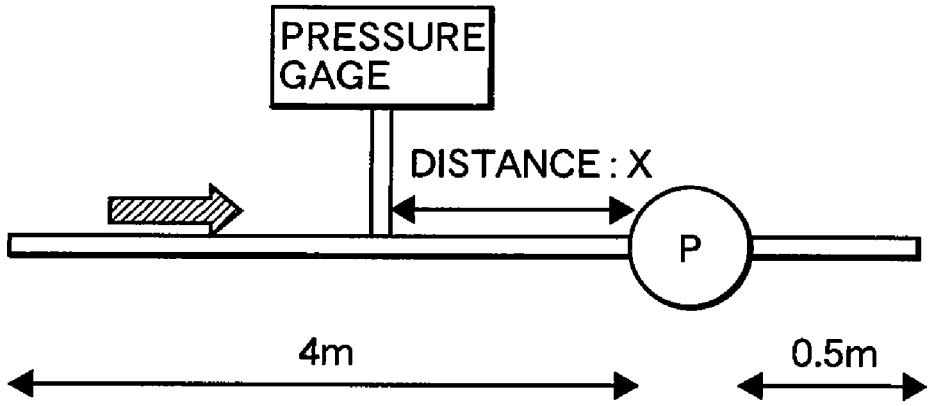
FIG. 5A shows a second state of the piping connected to the pump.
Figure 5B:
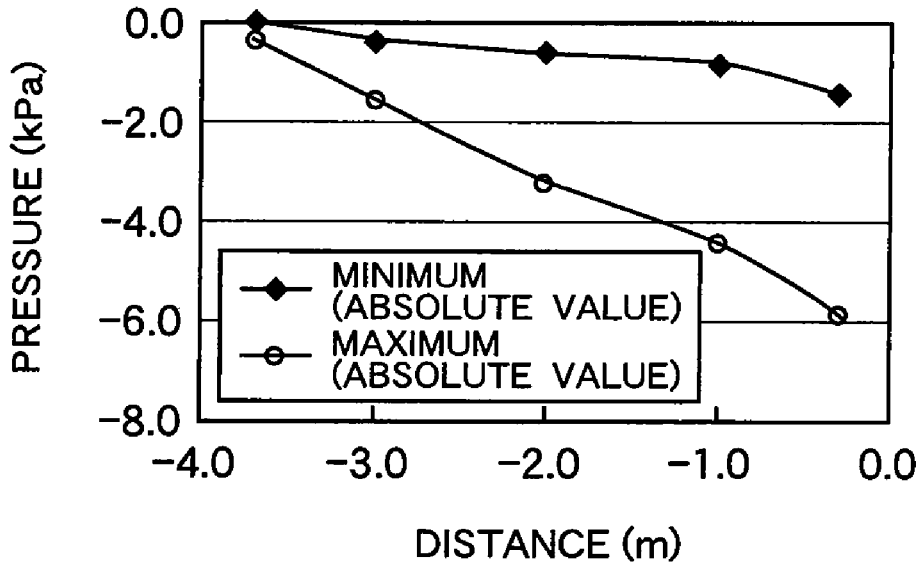
FIG. 5B shows the relationship between the distance of the piping and the pressure in the piping.

FIG. 5A shows a layout of the ink collecting pump and pressure gage, on the condition that the distance between the intake aperture and the ink collecting pump is 4 m, and the distance between the ink collecting pump and the discharge aperture is 0.5 m. FIG. 5B shows maximum pressures and minimum pressures measured at various measurement points shifted to the intake side, relative to the position (0) of the ink collecting pump. The difference between the maximum pressure and minimum pressure becomes large as the distance between the intake aperture and ink collecting pump is shortened. Since the transfer rate is low with a large absolute value of pressure and high with a small absolute value of pressure, the flow becomes unstable, being fast and slow periodically. FIG. 5A shows the ink collecting method used by the conventional inkjet recording apparatus, and FIG. 4A shows the ink collecting method according to the present invention, indicating that the ink collecting method according to the present invention can collect ink stably with a low collecting capacity, as compared with the conventional method.

According to the above measurement results, in this embodiment, a pump having a transfer capacity of about one-third that of the collecting pump 14 used in the conventional inkjet printer is provided in the recording head. Since the transfer capacity can be reduced, the pump can be made compact, enabling the collecting pump 14 to be disposed in the recording head. Since the low transfer capacity results in a small amount of gas to be mixed with a liquid, the amount of solvent vapor can also be reduced.

Next, the method of driving the ink collecting pump in this embodiment will be described with reference to FIGS. 1 to 3.

Figure 2:
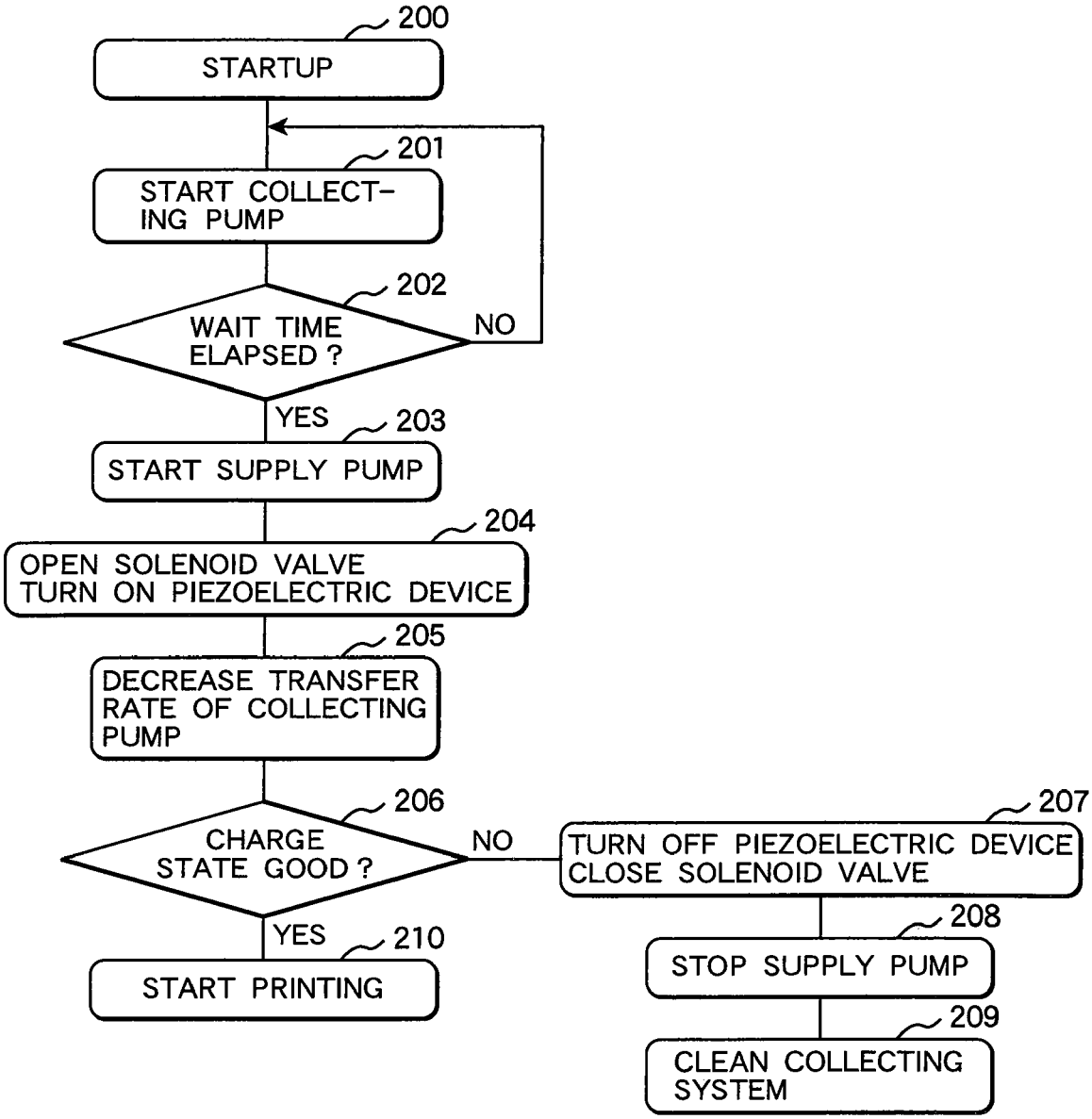
FIG. 2 illustrates the method of starting up the inventive inkjet recording apparatus.

FIG. 2 shows a procedure for starting the inkjet recording apparatus. When an operator enters an input (startup) for starting operation on the touch panel (operation panel 40) (200), the ink collecting pump 14 first starts to operate (201). Ink left in the ink collecting path 22 moves; after a preset wait time to obtain a steady flow elapses (202), the supply pump 2 starts to operate (203). The wait time is provided because a pump smaller than the conventional pump is used in this embodiment, and therefore some time is required for ink in a stopped state to flow steadily.

After the supply pump 2 has started to operate, the solenoid valve 32 in the recording head 101 opens and ink is expelled from the nozzle 6. A voltage is then applied to the piezoelectric device to break down the ink into particles (204).

Then, the transfer rate of the ink collecting pump 14 is reduced (205). In reality, the amount of air transferred is reduced because the amount of ink expelled from the nozzle 6 is constant. This reduction is performed to reduce the amount of vapor of the solvent such as methyl ethyl ketone (MEK). A transfer rate that does not impede ink collection is set. The charge state of the ink particles is measured by the charge sensor 33 (206). If the charge state is superior, the processing proceeds to a print start mode (210). If the charge state is abnormal, power to the piezoelectric device is turned off and the solenoid valve 32 is closed (207). After the supply pump 2 is stopped (208), a command to supply a small amount of solvent to the gutter 11 is given to the operator on the operation panel 40 so as to perform the cleaning of the collecting system (209). The method of detecting the abnormal charge state will be described later.

Figure 3:
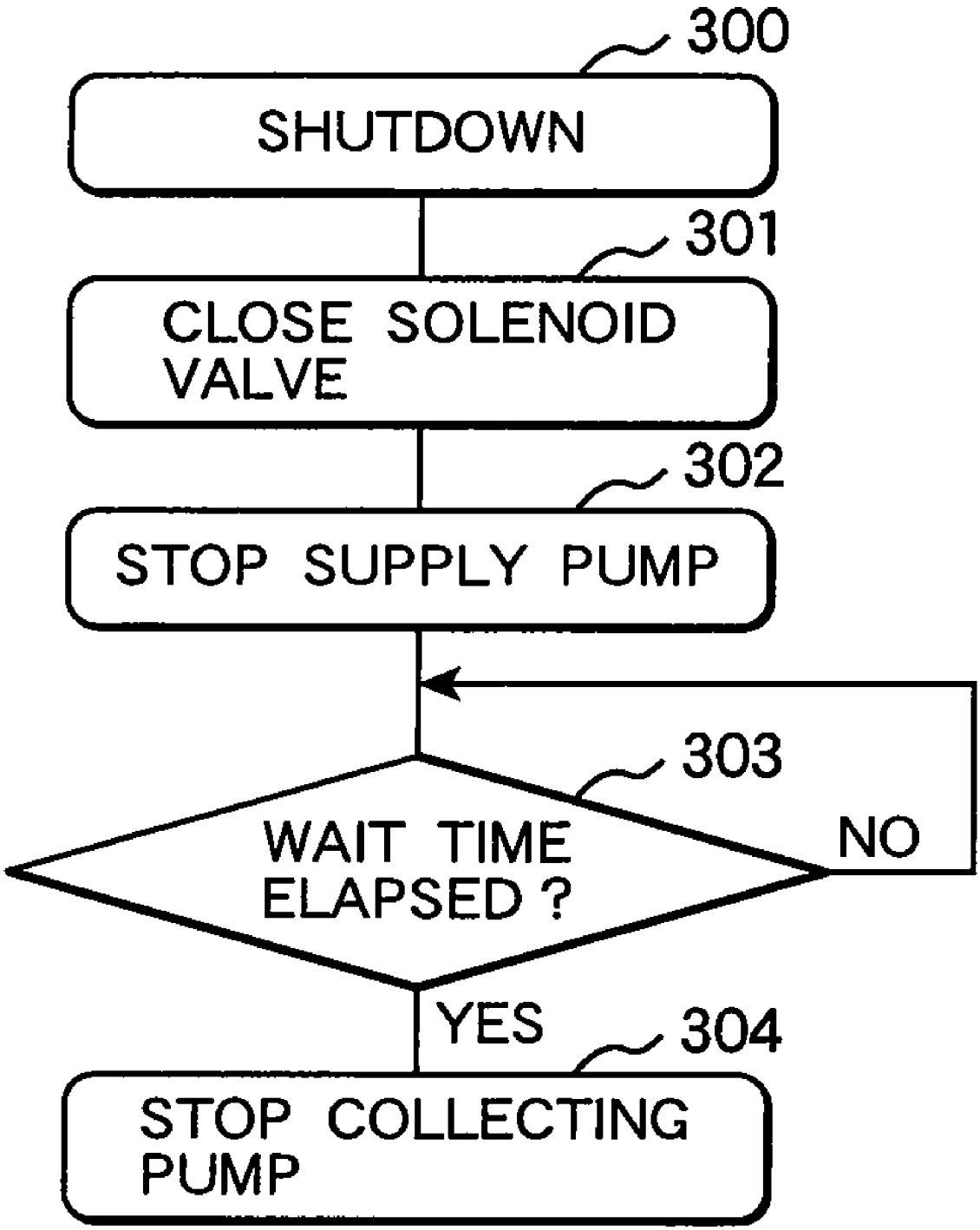
FIG. 3 illustrates the method of shutting-down the inventive inkjet recording apparatus.

FIG. 3 shows a procedure for stopping the inkjet recording apparatus. When the operator enters an input for stopping the operation on the touch panel 40 (300), the solenoid valve 32 first closes (301) and then the supply pump 2 stops operating, stopping the ink supply to the nozzle 6 (302). A wait state then continues until most of the ink present in the ink collecting path 22 is collected into the ink container 1. After a preset time has elapsed (303), the ink collecting pump 14 stops (304).

Next, the pump operating method during steady operation of the inkjet recording apparatus will be described. When the inkjet recording apparatus is operating, air is sucked from the gutter 11 together with ink. This causes dust floating near the gutter 11 to be sucked. The dust is caught by the filter 12 disposed upstream of the suction pump (ink collecting pump 14), so the filter 12 is clogged with an elapse of time. The dust clog reduces the efficiency of the ink collecting pump 14, thereby lowering the ink collection rate at the gutter 11. The lowered ink collection rate changes ink charge measurements taken near the charge sensor 33 disposed downstream of the gutter 11. When the change is detected, the ink collecting pump 14 is controlled so that the amount of ink to be collected is increased. Accordingly, the ink collection rate can be increased without the inkjet recording apparatus having to be stopped. Even when the collection flow rate of the ink collecting pump 14 is increased, the amount of air to be sucked does not change largely in reality due to the clog. This prevents the amount of solvent vapor from increasing. When the filter 12 is heavily clogged, which is an obstacle to ink collection, a message for promoting the cleaning of the filter 12 may be displayed on the operation panel 40. Accordingly, the filter 12 can be cleaned while the operation status of the production line is adjusted.

The method of detecting the amount of ink charge will be described below with reference to FIGS. 1, 6, and 7.

Figure 1:
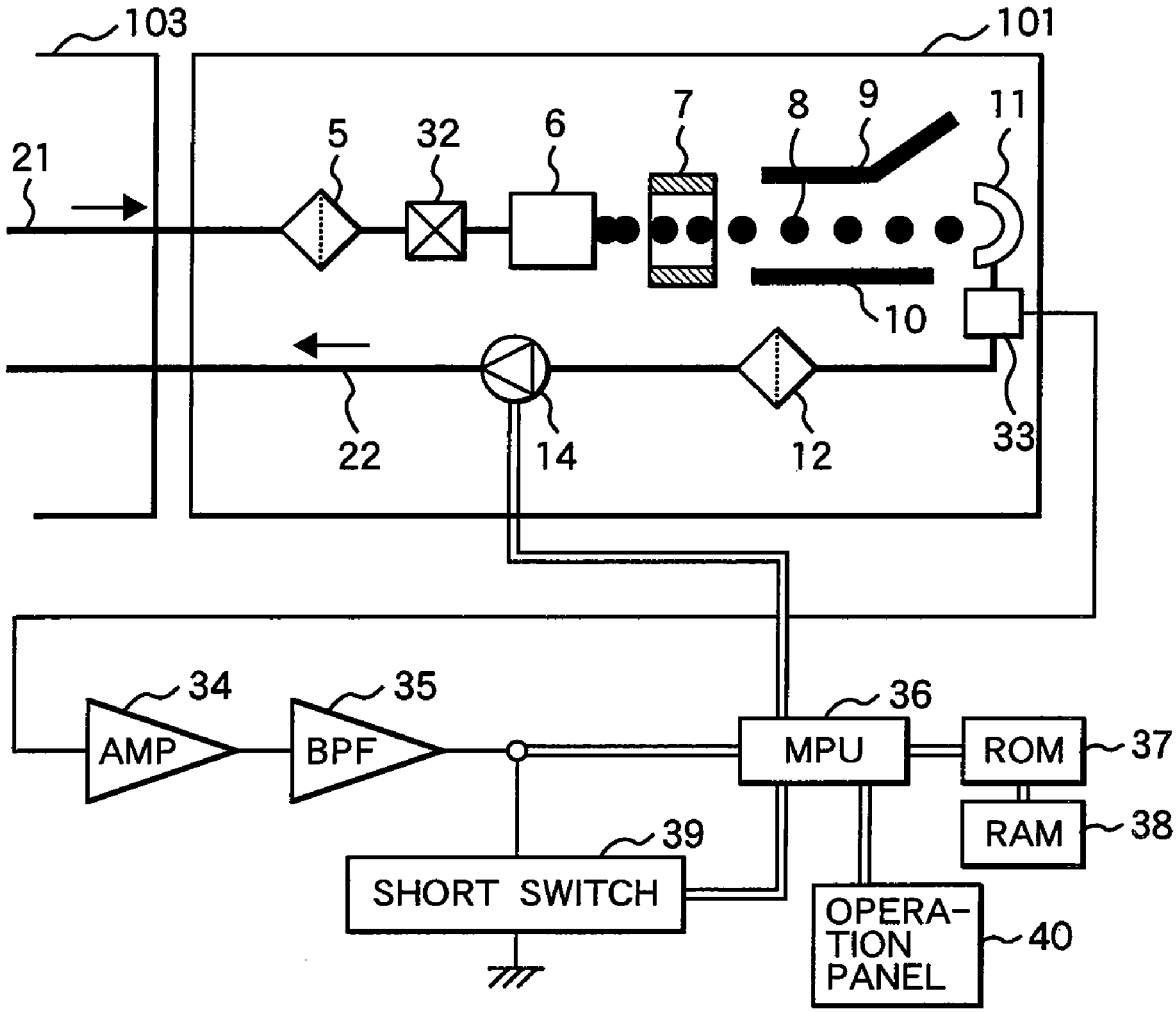
FIG. 1 illustrates the method of controlling the pumps in the inventive inkjet recording apparatus.

FIG. 1 shows a control system for changing the collection rate of the collecting pump 14 according to the amount of ink charge detected. The method of changing the ink collection rate will be described with reference to the drawing. The charge sensor 33 is provided between the gutter 11 and filter 12; it detects the amount of charge of the ink collected from the gutter 11. When ink passes between the charging electrodes 7, it is charged according to the voltage applied across the charging electrodes 7. During printing, a voltage is applied across the deflecting electrodes 9 and 10, so the frequency of the pulse used to detect the amount of charge is the same as the frequency of the pulse applied to the piezoelectric device used to break down the ink into particles, and the voltage is low enough that the ink particles do not move off the gutter 11. The charged particles are collected in the gutter 11 and pass through the charge sensor 33. A voltage signal obtained by the charge sensor 33 is amplified thousands or tens of thousands of times by an amplifier 34, and the noise component is eliminated by a band-pass filter 35. A short switch 39 is turned on periodically, and the amount of ink charge is measured repeatedly. The detection result of the signal is sent to a microprocessor (MPU) 36. The microprocessor 36 is a circuit element that controls the entire inkjet printer. A ROM 37 and RAM 38 are connected to the microprocessor 36. The ROM 37 is a memory for storing programs and data that are necessary to operate the microprocessor 36, and the RAM 38 is a memory for temporarily saving data that is handled by the microprocessor 36 during program execution.

Figure 6:
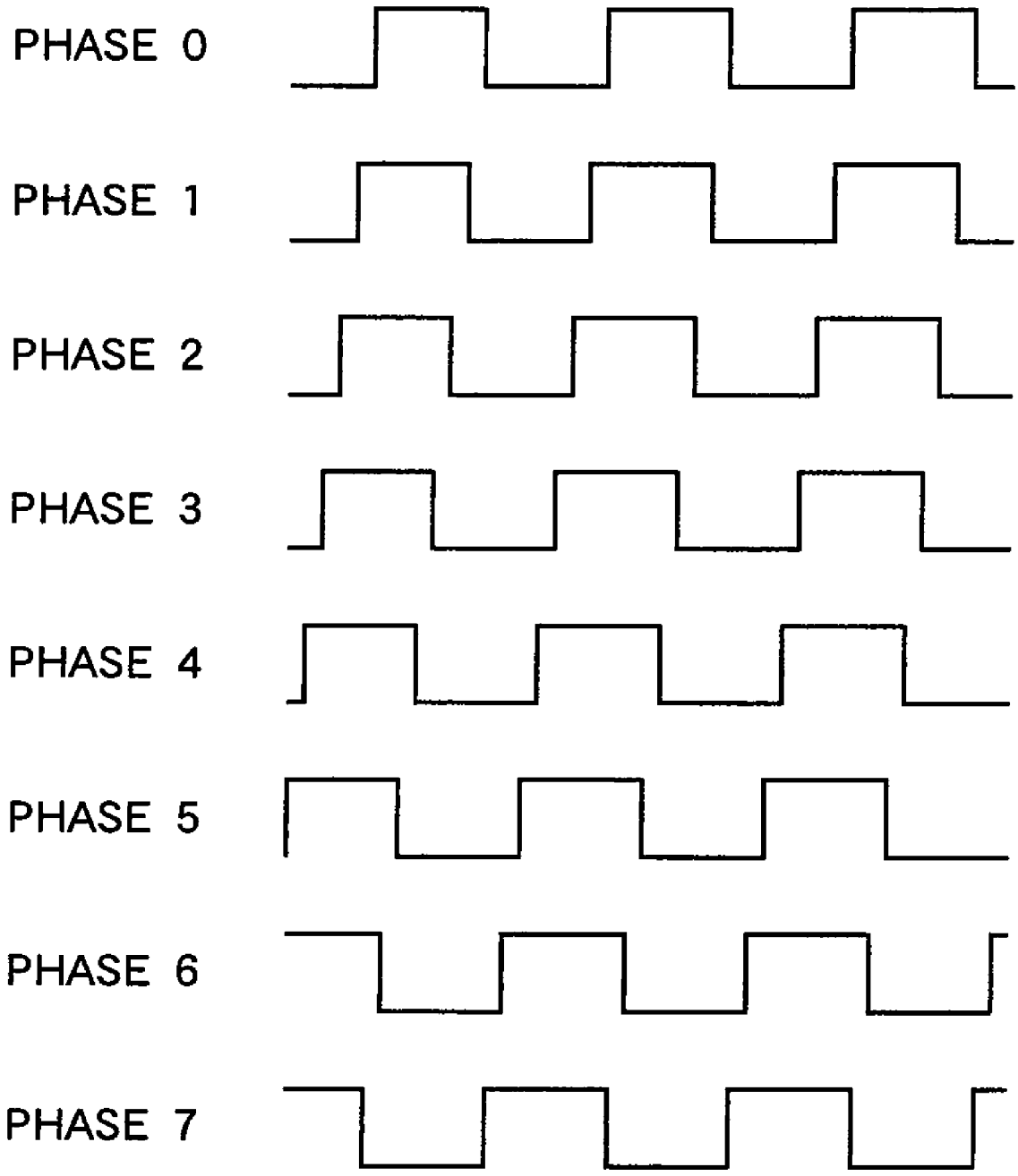
FIG. 6 shows pulse trains used to check the charge state of the ink droplets to be broken down into particles.

FIG. 6 shows eight voltage pulses used for detecting the amount of charge. The pulses have the same frequency as the pulse applied to the piezoelectric device, but have different phases from the pulse applied to the piezoelectric device. The eight types of pulses are applied in succession to the charging electrodes to charge the particles, and the amounts of charge are detected by the charge sensor 33. The pulse with the optimum phase is then determined and the particles are charged to perform printing. The method of determining the optimum phase will be described below.

As described above, the ink expelled from the orifice provided at the end of the nozzle 6 receives vibration of the piezoelectric device provided in the nozzle and vibrates. The ink is then broken down into particles in the space between the charging electrodes. At the moment of the breakage into particles, the particles are charged in proportion to the voltage applied to the charging electrodes. The position at which the ink is broken down into particles depends on the ink viscosity, so it is necessary to check for each particle the optimum timing (phase difference from the phase of the signal to be applied to the piezoelectric device) at which a charge signal is given. First, a fixed number (20, for example) of pulses with phase 0 are applied to the charging electrodes. Twenty ink particles that have passed through the space between the charging electrodes during the application enter the gutter 11. The amount of charge of the 20 ink particles is detected by the charge sensor 33. After initialization by turning on the short switch 39, the fixed number of pulses with phase 1 are applied, and the amount of charge of other 20 ink particles is measured in the same way.

Figure 7A:
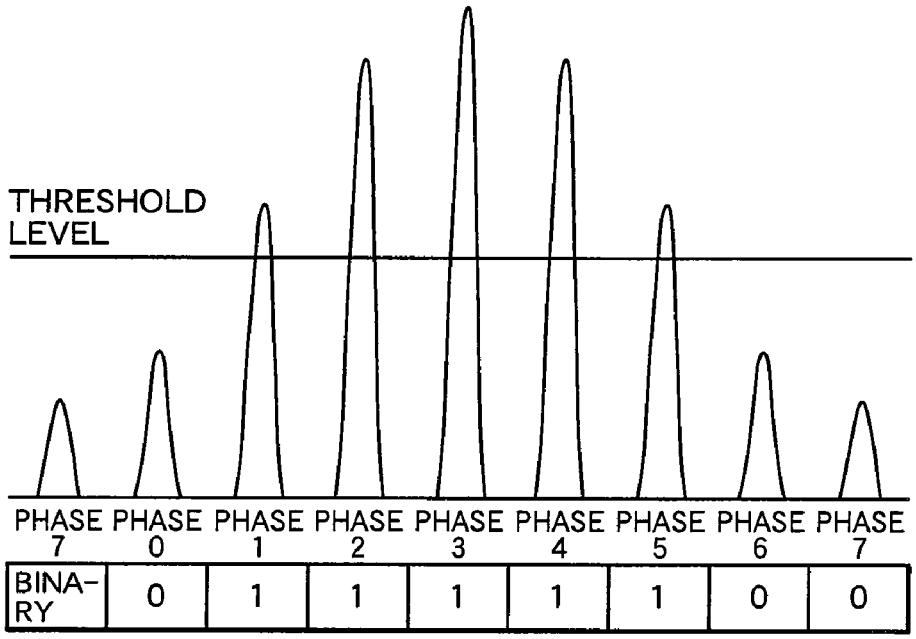
FIGS. 7A and 7B show exemplary voltage waveforms detected by a charge sensor when the pulse trains shown in FIG. 6 are applied.
Figure 7B:
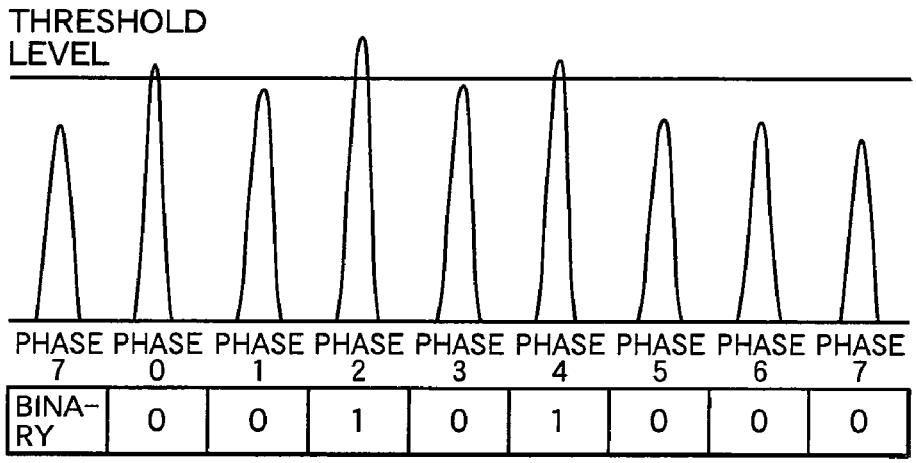

After the measurement is repeated for the eight phases, voltage waveforms as shown in FIG. 7A are detected by the charge sensor 33. In the example in the drawing, phase 3 provides the best match with the timing at which the ink is broken down into particles, and the amount of ink charge is maximized in that phase. Since this state indicates that ink is collected appropriately, the other amounts of charge are changed depending on the pulse generated by shifting the phase. If an appropriate threshold level is preset and the measured values are represented by binary values according to whether the measured value is greater or smaller than the threshold level, the binary values for phases 1 to 5 are 1 in succession and the binary values for phases 6 to 0 are 0 in succession. If it is found that this tendency remains the same even when the threshold level is changed from A to B, it can be seen that phase 3 is the optimum timing to apply pulses. During printing, phase 3 is used as a timing to switch the charge voltage, changing the amount of charge for each particle. The amount of charge can be detected when the state of collection by the collecting pump is superior.

When the ink collection state is worsened, the charge sensor 33 detects voltage waveforms as shown in in case of threshold level B, all binary values become 1. When these states are detected, the ink collection state is decided as being worsened.

When a worsened ink collection state is detected, control is performed so that the collection rate of the ink collecting pump is increased and thereby stable apparatus operation is achieved.

A factor that changes the ink collection state is ink temperature. When the temperature of ink drops, its viscosity increases, thereby to increase the flow path resistance, lowering the ink transfer rate. To address this problem, the temperature near the ink container is measured; when the ink temperature is changed and thereby the fluid resistance increases, the collection rate of the ink collecting pump is set so that the optimum collection state is assured.

Since the inkjet recording apparatus related to the present invention is used on a production line, the tube interconnecting the ink container and recording head needs to be 2 m to 4 m long. When the maximum position of the ink collecting path is positioned above the recording head, the flow path resistance is increased. If the ink collection path is positioned above the recording head and the difference in height becomes large, therefore, the flow path the tube interconnecting the ink container and recording head needs to be 2 m to 4 m long. When the maximum position of the ink collecting path is positioned above the recording head, the flow path resistance is increased. If the ink collection path is positioned above the recording head and the difference in height becomes large, therefore, the flow path resistance becomes large, lowering the ink transfer rate. When a difference between the highest position of the ink collecting path and the position of the recording head is input from the touch panel so that the collection rate of the collecting pump becomes appropriate, ink collection can be stabilized.

According to the present invention, an ink collecting circuit causing few flow rate variations in time can be formed by disposing a collecting pump in the recording head, which enables the collecting pumps used in the conventional inkjet recording apparatus to be replaced with a pump with a lower collection flow rate. Accordingly, the amount of solvent vapor during ink transfer can be reduced, providing the effect of preventing the environment from being worsened.

According to the present invention, the differential pressure between the gutter and ink collecting pump can be set to the atmospheric pressure or above and the restriction imposed on the length of the ink collecting path due to the differential pressure is eliminated, so it is possible to provide an inkjet recording apparatus that has an ink collecting path longer than the conventional ones and can flexibly adapt to user equipment.

The invention claimed is:

1. An inkjet recording apparatus, which comprises an ink container for storing ink, a supply pump for supplying the ink from the ink container to a recording head, a collecting pump for collecting ink from the recording head to the ink container, an ink supply path and an ink collecting path that each interconnect the ink container and the recording head, the recording head including a nozzle for expelling the ink supplied by the supply pump as ink particles, charging electrodes for charging the ink particles, deflecting electrodes for deflecting the charged ink particles by means of an electrostatic field, and a gutter for collecting ink that has not been used, wherein:

the collecting pump is disposed in the recording head, and a means is provided for measuring an amount of charge of the ink collected in the gutter and changing an amount of collection by the collecting pump according to a measurement result of the amount of charge.

2. The inkjet recording apparatus according to claim 1, further comprising a means for changing the amount of collection by the collecting pump according to a difference in height between the position of the ink collecting path and the position of the nozzle.

3. The inkjet recording apparatus according to claim 1, further comprising a means for measuring a temperature around the ink container and changing the amount of collection by the collecting pump according to a measurement result.

4. The inkjet recording apparatus according to claim 1, wherein an amount of collection by the collecting pump during startup is greater than the amount of collection during a printing process.

* * * * *